US010436555B1

(12) United States Patent
Haugan

(10) Patent No.: US 10,436,555 B1
(45) Date of Patent: Oct. 8, 2019

(54) TARGET WITH SELF-CONTAINED ENHANCED VISUAL SHOT PLACEMENT IDENTIFICATION

(71) Applicant: Thomas Rye Haugan, Oak Grove, MN (US)

(72) Inventor: Thomas Rye Haugan, Oak Grove, MN (US)

( * ) Notice: Subject to any disclaimer, the term of this patent is extended or adjusted under 35 U.S.C. 154(b) by 0 days.

(21) Appl. No.: 16/218,629

(22) Filed: Dec. 13, 2018

Related U.S. Application Data

(60) Provisional application No. 62/651,116, filed on Mar. 31, 2018.

(51) Int. Cl.
*F41J 5/22* (2006.01)
*F41J 5/24* (2006.01)

(52) U.S. Cl.
CPC .. *F41J 5/24* (2013.01); *F41J 5/22* (2013.01)

(58) Field of Classification Search
USPC ..... 273/378–380
See application file for complete search history.

(56) References Cited

U.S. PATENT DOCUMENTS 3,330,561 A 7/1967 Kandel
4,243,228 A * 1/1981 Marcella ..... F41J 5/24 273/363
4,781,595 A * 11/1988 Cox ..... A63F 3/0685 434/328
4,921,256 A * 5/1990 Gearhart ..... F41J 1/01 273/378
5,197,743 A * 3/1993 Hanson, Jr. ..... F41J 3/0071 273/348
6,966,557 B2 * 11/2005 Kirk ..... A63F 9/0243 273/349
8,814,167 B2 8/2014 Davis, Jr.
9,494,391 B1 11/2016 Broadbent
9,958,239 B1 5/2018 Snell et al.
2008/0277875 A1 * 11/2008 Mincenberg ..... F41J 1/01 273/378
2013/0038020 A1 * 2/2013 Davis, Jr. ..... F41J 5/24 273/378
2013/0228974 A1 * 9/2013 Davis, Jr. ..... F41J 5/24 273/378
2013/0270773 A1 * 10/2013 Johnson ..... F41J 5/24 273/408
2014/0175746 A1 * 6/2014 Fife ..... F41J 5/20 273/378

* cited by examiner

*Primary Examiner* — Mark S Graham

(57) ABSTRACT

An improved shooting target having a printed front face sheet mounted to a core sheet which has an integral cutout area positioned directly behind the aim point of the printed target face. Dye-filled packets positioned within the cutout area are held in place with the glue of an adhesive faced backer sheet which covers the back side of the cutout area of the core sheet and is held in place by adhering to the back face of the core sheet. The result is an improved target having the qualities of providing the marksman or recreational shooter with immediate enhanced visual identification as to the impact area of their shot as the projectile bursts a dye packet leaving a colorful or contrasting mark on the printed target face.

5 Claims, 1 Drawing Sheet

TARGET WITH SELF-CONTAINED ENHANCED VISUAL SHOT PLACEMENT IDENTIFICATION

CROSS-REFERENCE TO RELATED APPLICATIONS

This application claims the benefit of provisional patent Ser. No. 62/651,116, filed 2018 Mar. 31 by the present inventor.

BACKGROUND—PRIOR ART

The following is a tabulation of some prior art that presently appears relevant:

U.S. Patents

| U.S. Pat. No. | Kind Code | Issue Date | Patentee |
|---|---|---|---|
| 9,958,239 | B1 | 2018 May 01 | Ts Founders LLC |
| 9,494,391 | B1 | 2016 Nov. 15 | Blistercell, LLC |
| 3,330,561 | A | 1967 Jul. 11 | Kandel |
| 8,814,167 | B2 | 2014 Aug. 26 | ZMB Industries LLC |

This invention relates to the activity of target shooting with firearms, archery, crossbows or related projectile launching devices whereby the shot placement location is made more visibly apparent.

The shooting of common traditional paper targets has always included the challenge of being able to visually identify the projectile's exact point of impact on the target. This challenge becomes increasingly difficult as the distance between the shooter and the target increases or if the size of the projectile is small, as in with the case of small caliber bullets.

In order to overcome this challenge shooters have been required to intermittently cease firing in order to walk to the target to make a closer visual inspection of their shot placement. This activity does not provide immediate shot placement feedback and is time consuming. It also requires that all shooters in that area cease firing until the inspection is complete. Other methods of shot placement identification have included the utilization of binoculars or spotting scopes by the shooter to inspect the impact area after taking shots. This viewing equipment can be expensive and its use adds an additional step to the activity of target shooting.

A number of solutions have been proposed to overcome this challenge of not being able to immediately identify the projectile's point of impact on the target. For example in U.S. Pat. No. 9,494,391 (2016) to Blistercell, LLC, an array of dye-containing blisters is secured to the back face of the paper target via adhesive. The desired effect is to have the dye mixture become visually apparent on the front face of the target after being struck by a projectile. This effect is minimized with this construction as the bulk of the dye is lost out of the back of the target where it is not visible. Another drawback to this solution is that it requires both the purchase of and the assembly of the paper target and the dye-containing blisters.

Another proposal, U.S. Pat. No. 9,958,239 (2018) to Ts Founders LLC, discloses a marking fluid receptacle which attaches to the front face of the target panel. Shot placement is identified as marking fluid is released from the receptacle after being struck by a projectile. This construction greatly alters the appearance of the printed target face as the fluid receptacle covers much of it. It no longer has the look and detail of a traditional printed target. It also requires assembly of the multiple components.

U.S. Pat. No. 3,330,561 (1967) to Kandel describes a self-contained alternative whereby a colored dye material is encased in a grid that is sandwiched between a target front and a back sheet. This construction requires the front and back sheets to have a waterproof component. The grid structure of this design encompasses the entirety of the target area rather than provide an isolated hit-zone for the shooter to aim for.

Another target disclosed in U.S. Pat. No. 8,814,167 (2014) ZMB Industries LLC uses fluid carriers fitted within a three-dimensional form which, when struck by a projectile, will break and bleed out of the front of the target indicating a hit. These targets have the disadvantage of being exceedingly expensive when compared to traditional targets and their alternatives. Additionally, these targets are more difficult to transport and store compared to two-dimensional targets.

SUMMARY

In accordance with one embodiment a target involves a two-dimensional reactive shooting aid that produces a highly visible mark around the area where a projectile has landed. An aspect of the target comprises of a printed face sheet adhered to a thicker core sheet which has a cutout area within it. This cutout area of the core sheet is positioned directly behind the aim-point or score-area of the printed face sheet. Dye-filled packets are placed within the cutout area and are held in place with an adhesive faced backer sheet which is adhered to the back of the core sheet and covers the cut-out area.

Accordingly several advantages of one or more aspects are as follows: To provide a target which has the appearance of and can be printed in the manner and design of commonly popular paper targets currently widely in use. To provide a target where the reactive features are completely self-contained and the target is ready to use, requiring no assembly. To provide a target which is lightweight, stackable, inexpensive to produce, easily portable, and which delivers a more dramatic and entertaining reactive effect than prior art reactive targets. These and other benefits of one or more aspects will become apparent from a consideration of the ensuing description and drawings.

DRAWINGS—FIGURES

DRAWINGS—REFERENCE NUMERALS

101 printed target face sheet
102 core sheet with cutout area
103 dye-filled packets
104 adhesive-front backer sheet

DETAILED DESCRIPTION—FIG. 1 AND FIG. 2

Figure 1:
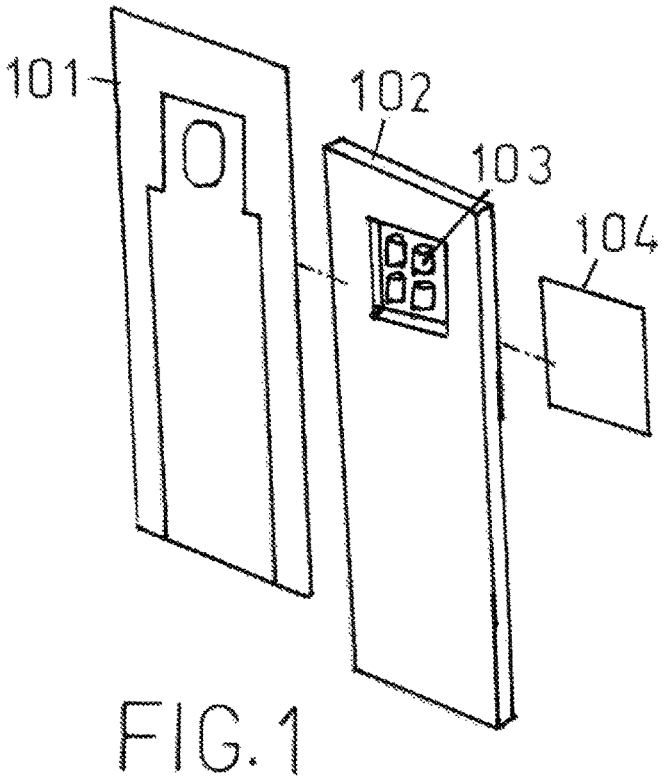
FIG. 1 shows a perspective view of deconstructed layers of an embodiment of a reactive shooting target that produces a highly visible mark around the area where a projectile has landed.

One embodiment of the target is illustrated in FIG. 1. In this deconstructed perspective view the printed target face sheet 101 is to be laminated or adhered to a core sheet with cutout area 102. In one embodiment the target face sheet 101 is an absorbent material such as paper. However the target face sheet 101 can consist of any material, such as polyethylene, styrene, vinyl, paperboard, blotter board, etc., that can be printed and is penetrable via a launched projectile. The core sheet with cutout area 102 is a material such as cardboard but can consist of any material of varying thickness and rigidity including chipboard, foam board, wood, styrene, corrugated plastic board, etc.

Within the cut-out area of the core sheet 102 in FIG. 1 is positioned dye-filled packets 103. The packets 103 are held in place by the glue of an adhesive-front backer sheet 104 which is itself adhered to the back side of the core sheet 102 and is covering the cutout area. The dye-filled packets 103 then sit in close proximity to or in direct contact with the back side of the aim point area of printed target face sheet 101. In one embodiment the dye-filled packets 103 are filled with a colored liquid. However the packets 103 can be filled with a colored or visually contrasting powder or gel. The shell of the dye-filled packets 103 in one embodiment are of a flexible pillow-formed waterproof plastic however they can consist of any material which can hold a marking substrate and can be burst via a projectile.

Figure 2:
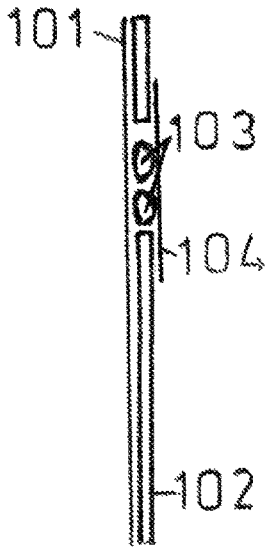
FIG. 2 shows a simple cross sectional view of an embodiment of a reactive shooting target.

FIG. 2 illustrates a cross section of one embodiment where printed target face sheet 101 is laminated to core sheet 102. Dye-filled packets 103 sit directly adjacent to the backside of printed target face sheet 101 and within the cutout area of core sheet 102. The dye-filled packets 103 are held in place by being in direct contact with the adhesive-front backer sheet 104. The adhesive-front backer sheet 104 is itself held in place by adhering to the back side of core sheet 102 while also completely covering the cutout area of the core sheet 102. The adhesive-front backer sheet 104 in one embodiment is a pressure sensitive paper however it can consist of pressure sensitive vinyl sheeting, pressure sensitive paperboard, cloth tape, duct tape, paper backed tape, polypropylene tape, polyester tape, gummed tape, etc.

Figure 3:
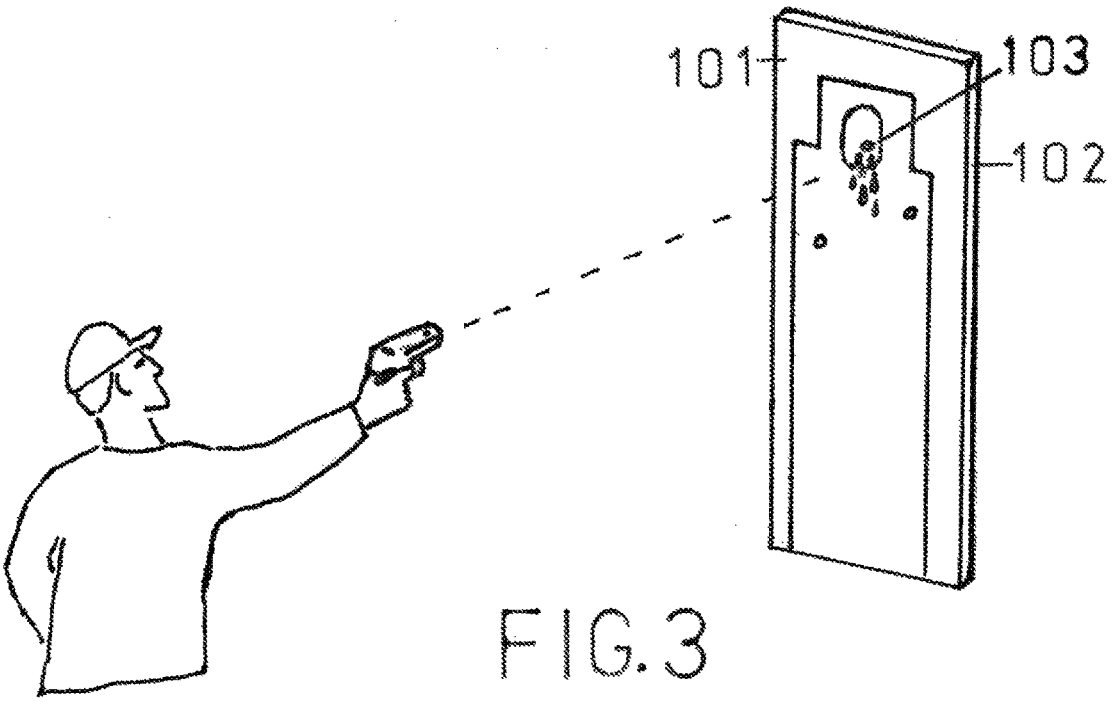
FIG. 3 shows a perspective view of an embodiment where a shooter is actively using said target.

Operation—FIG. 3

Illustrated in FIG. 3 is a perspective view of one embodiment. A shooter is actively using the target with a firearm and is aiming at the circular area on the front of the printed target face sheet 101.

The shooter's projectile is illustrated to have hit the aim zone directly in front of and in line with a dye-filled packet 103 which resides within the cutout area of core sheet 102. Upon impact the dye-filled packet 103 has burst and, due to the physical phenomenon of back spatter, a portion of the dye is projected back towards the source of the projectile and out onto the front face of the target face sheet 101. This effect gives the shooter immediate visual indication as to the placement of their shot on the target face. Since one embodiment includes multiple dye-filled packets 103, the shooter has multiple opportunities to receive this visual indication of shot placement as more shots are fired at target face sheet 101 and more dye filled packets 103 are penetrated and burst.

CONCLUSION, RAMIFICATIONS, AND SCOPE

Thus, since the target face sheet 101 can have the size, shape, and imprinting of commonly popular paper targets currently widely used in recreation, competitive sport, and in military and law enforcement training, the shooter will be immediately familiar with the use of and the aim point of the embodiment. The embodiment is virtually two-dimensional in shape allowing it to be easily stacked, transported, and set up. The relative simplicity of the embodiment, and the limited number of components required to produce it, make for a target which is lightweight and inexpensive to produce. The utilization of liquid filled pillow formed packets 103 in the embodiment creates a more dramatic and visually apparent image on the front face of printed target face sheet 101.

While my above description contains many specificities, these should not be construed as limitations on the scope, but rather as an exemplification of one embodiment thereof. Many other variations are possible. For example, multiple aim points could printed on the target face, behind which each would have dye packets placed; the shape of the target itself can be rectangular, square, circular, oval, or be cut into a silhouette shape, etc.; the target face can be printed with traditional concentric target circles, ovals, squares, grids, animal images, etc.

Thus the scope of the embodiments should be determined by the appended claims and their legal equivalents, rather than their examples given.

What is claimed is:

1. A target for shooting comprising:

a target panel comprising a core sheet having a front face, a back face, a flat shape and having a cutout area, and a printed face sheet having a flat two-dimensional shape and having a printed front face and having a back face mounted to the front face of said core sheet, and one or more liquid dye-filled packets positioned within the cutout area of said core sheet, wherein said liquid dye-filled packets are in close proximity to the back face of said printed face sheet, and an adhesive-front backer sheet having a flat two-dimensional shape adhered to the back face of said core sheet, wherein said adhesive-front backer sheet is of a size larger than the cutout area of said core sheet, and completely covers the cutout area of said core sheet, and is adhered to said dye-filled packets such that said dye-filled packets are secured in place.

2. The target of claim 1, wherein said core sheet has a plurality of cutout areas, wherein one or more said dye-filled packets are positioned within each cutout area of said core sheet and are secured in place with said adhesive-front backer sheet.

3. The target of claim 1, wherein the dye of said dye-filled packets includes a colored powder or gel.

4. The target, of claim 1, wherein the shape of said printed face sheet is square, rectangle, oval, circular, or in the form of an animal.

5. The target of claim 1, wherein said core sheet is made of cardboard, chipboard, wood, styrene, foam core, or corrugated plastic.

* * * * *